US008225868B2

(12) United States Patent
Morley et al.

(10) Patent No.: US 8,225,868 B2
(45) Date of Patent: Jul. 24, 2012

(54) APPARATUS AND METHOD FOR MOUNTING ACOUSTIC SENSORS CLOSER TO A BOREHOLE WALL

(75) Inventors: Jan Stefan Morley, Houston, TX (US); Alain Dumont, Kawasaki (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 792 days.

(21) Appl. No.: 12/333,284

(22) Filed: Dec. 11, 2008

(65) Prior Publication Data

US 2010/0147590 A1 Jun. 17, 2010

(51) Int. Cl.
*E21B 47/01* (2006.01)

(52) U.S. Cl. ..... 166/254.2; 166/241.4; 175/325.5

(58) Field of Classification Search ..... 175/50, 175/325.1, 325.4, 325.5; 166/250.01, 254.2, 166/241.4

See application file for complete search history.

(56) References Cited

U.S. PATENT DOCUMENTS

| | | | | |
|---|---|---|---|---|
| 4,384,626 | A * | 5/1983 | Derouin | 175/57 |
| 5,235,285 | A | 8/1993 | Clark et al. | |
| 5,339,036 | A | 8/1994 | Clark et al. | |
| 5,339,037 | A | 8/1994 | Bonner et al. | |
| 5,463,320 | A * | 10/1995 | Bonner et al. | 324/366 |
| 6,032,748 | A * | 3/2000 | DeBray et al. | 175/325.7 |
| 6,585,044 | B2 * | 7/2003 | Rester et al. | 166/250.01 |
| 6,910,534 | B2 * | 6/2005 | Linyaev et al. | 166/250.11 |
| 6,997,258 | B2 * | 2/2006 | Homan et al. | 166/254.2 |
| 7,114,562 | B2 * | 10/2006 | Fisseler et al. | 166/250.02 |
| 7,284,605 | B2 | 10/2007 | Clark et al. | |
| 7,392,861 | B2 | 7/2008 | Fouillou et al. | |
| 7,398,697 | B2 | 7/2008 | Allen et al. | |
| 2005/0006090 | A1 | 1/2005 | Chemali et al. | |
| 2005/0205268 | A1 * | 9/2005 | Engels et al. | 166/381 |
| 2006/0254767 | A1 | 11/2006 | Pabon et al. | |

FOREIGN PATENT DOCUMENTS

| | | |
|---|---|---|
| EP | 0505261 A2 | 9/1992 |
| EP | 0505261 A3 | 9/1992 |

* cited by examiner

*Primary Examiner* — Daniel P Stephenson

(74) *Attorney, Agent, or Firm* — Jianguang Du; Jody DeStefanis

(57) ABSTRACT

An interchangeable sleeve for a downhole tool includes a substantially cylindrical body configured to circumferentially engage the downhole tool, a blade extending radially from the body, and a transducer disposed within the blade. A drilling assembly includes a drill collar, an interchangeable blade configured to couple to the drill collar, and a transducer disposed within the blade. A size of the blade and a size of the transducer are selected based on a diameter of a borehole in which the downhole tool is to be used. A method of manufacturing an interchangeable sleeve for a downhole tool includes forming a blade on a body of the sleeve such that the blade extends radially from the body, disposing a transducer within the blade, and configuring the sleeve to circumferentially engage the downhole tool.

26 Claims, 12 Drawing Sheets

APPARATUS AND METHOD FOR MOUNTING ACOUSTIC SENSORS CLOSER TO A BOREHOLE WALL

BACKGROUND OF INVENTION

1. Field of the Invention

The present invention relates generally to borehole logging tools. More specifically, the present invention relates to apparatuses and methods for mounting transducers near a borehole wall.

2. Background Art

Borehole logging tools are used in the evaluation of formations surrounding boreholes for extraction of hydrocarbons. One important consideration in the design of logging tools is the coupling of transducers to the formation for deriving formation properties from formation logging data. Such coupling is needed to provide adequate signals in a downhole environment where power available to the transducers may be limited, such as in a downhole environment of a logging-while-drilling (LWD) system, which may be battery powered.

A typical LWD drilling assembly is illustrated in FIGS. 1-2. A drill string 12 is suspended within a borehole and includes a drill bit 15 at its lower end. A surface system includes a derrick assembly 2 positioned over the borehole, the assembly 2 including a rotary table 16, kelly 17, and rotary swivel 19. The drill string 12 is rotated by the rotary table 16, which engages the kelly 17 at the upper end of the drill string 12. The surface system further includes wellbore fluid 26 stored in a pit 27 formed at the well site. A pump 29 delivers the wellbore fluid 26 to the interior of the drill string 12 via a port in the swivel 19, causing the wellbore fluid to flow downwardly through the drill string 12, as indicated by a directional arrow 8. The wellbore fluid 26 exits the drill string 12 via ports in the drill bit 15, and then circulates upwardly through the annulus region between the outside of the drill string 12 and the wall of the borehole, as indicated by directional arrows 9. In this well-known manner, the wellbore fluid 26 lubricates the drill bit 15 and carries formation cuttings up to the surface as it is returned to the pit 27 for recirculation.

In order to derive formation properties from formation logging data, transducers or sensors are mounted onto a drilling assembly such as the one described above. In the LWD drilling assembly of FIG. 1, transducers 14 are mounted inside a drill collar 50. As shown in FIG. 14, sleeve 6 having low-density windows 6*a*, may be engaged to the drill collar 50 to collimate the passage of signals to and help exclude mud from the transducers 14. In FIG. 2, transducers 24 are mounted on a stabilizer 40 integrated with a body of the drill collar 50. The stabilizer 40 is an integral physical part of the drill collar 50.

SUMMARY OF INVENTION

In one aspect, the invention generally relates to an interchangeable sleeve for a downhole tool, the sleeve including: a body configured to circumferentially engage the downhole tool; a blade extending radially from the body; and a transducer disposed within the blade.

In another aspect, the invention generally relates to a drilling assembly including: a drill collar; and an interchangeable sleeve including: a substantially cylindrical body configured to circumferentially engage the drill collar; a blade extending radially from the body; and a transducer disposed within the blade.

In another aspect, the invention generally relates to a drilling assembly including: a downhole tool; an interchangeable sleeve including: a body configured to circumferentially engage the downhole tool; and a plurality of blades extending radially from the body; and a plurality of transducers disposed within the downhole tool and positioned to be offset from the blades.

In another aspect, the invention generally relates to a drilling assembly including: a downhole tool; an interchangeable blade configured to couple to the downhole tool, wherein a size of the blade is selected based on a diameter of a borehole in which the downhole tool is to be used; and a transducer disposed within the downhole tool, wherein a size of the transducer is proportional to the size of the blade.

In another aspect, the invention generally relates to a method of manufacturing an interchangeable sleeve for a downhole tool, the method including: forming a blade on a body of the sleeve such that the blade extends radially from the body; disposing a transducer within the blade; and configuring the sleeve to circumferentially engage the downhole tool.

In another aspect, the invention generally relates to a method of mounting transducers onto a downhole tool, the method including: providing an interchangeable sleeve including: a body; a blade extending radially from the body; and a transducer disposed within the blade; and circumferentially engaging the sleeve about the downhole tool.

In another aspect, the invention generally relates to a method of mounting transducers onto a downhole tool, the method including: providing a plurality of interchangeable sleeves, each having a body; forming a blade extending radially from the body on each of the sleeves, wherein a size of the blade is different for each of the sleeves; disposing a transducer within each of the blades, wherein a size of the transducer is proportional to the size of the blade; selecting a sleeve based on a diameter of a borehole in which the downhole tool is to be used; and circumferentially engaging the selected sleeve about the downhole tool.

In another aspect, the invention generally relates to a method of mounting transducers onto a downhole tool, the method including: providing a plurality of interchangeable blades, wherein a size of the blades is different from one another; disposing a transducer within each of the blades, wherein a size of the transducer is proportional to the size of the blade; selecting a blade based on a diameter of a borehole in which the downhole tool is to be used; and coupling the selected blade to the downhole tool.

Other aspects and advantages of the invention will be apparent from the following description and the appended claims.

DETAILED DESCRIPTION

Specific embodiments of the invention will be described with reference to the accompanying figures. Like items in the figures are shown with the same reference numbers.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
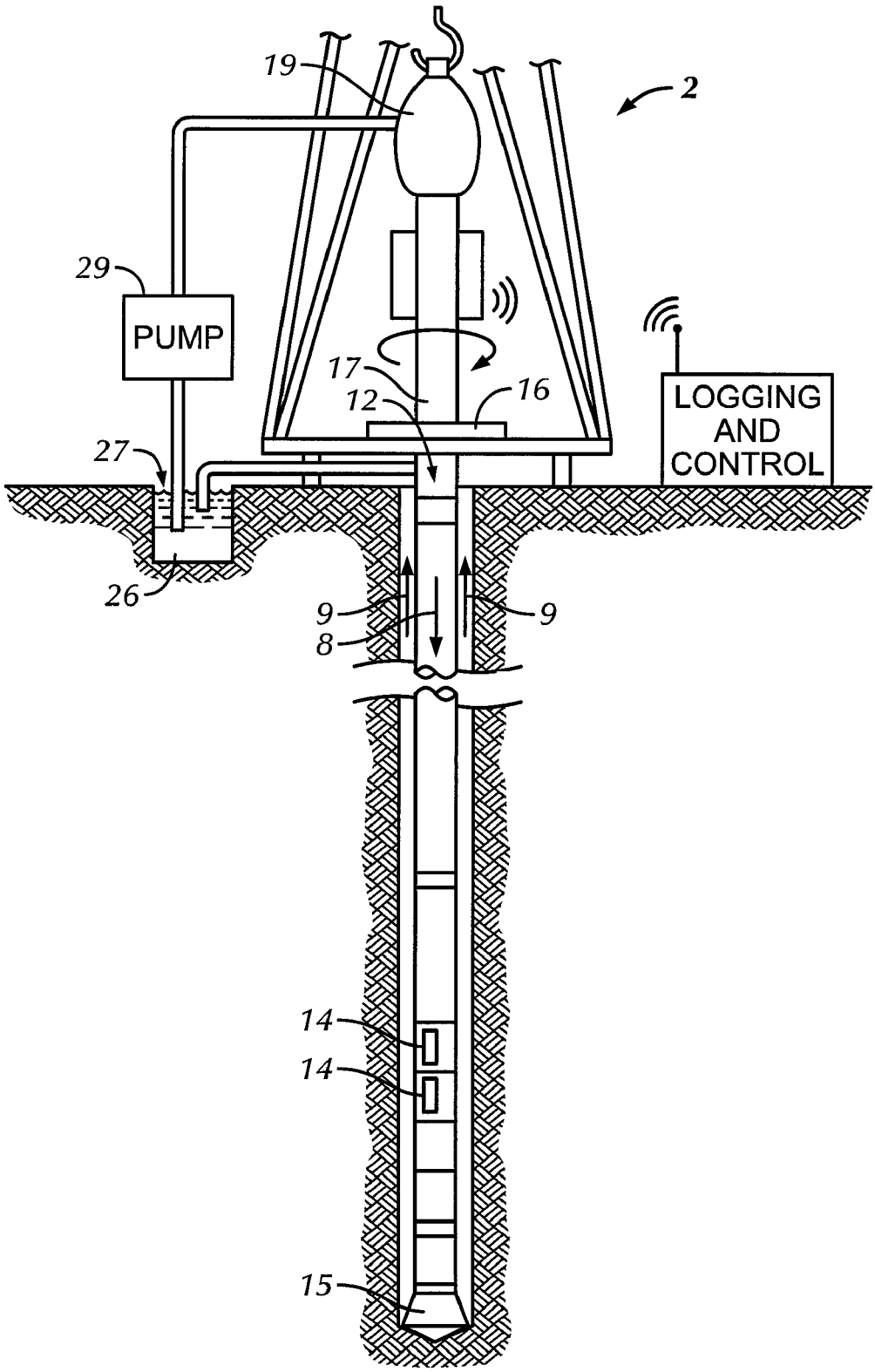
FIG. 1 (Prior Art)
FIG. 1 shows an example of a conventional method logging-while-drilling tool with transducers mounted thereon.
Figure 2:
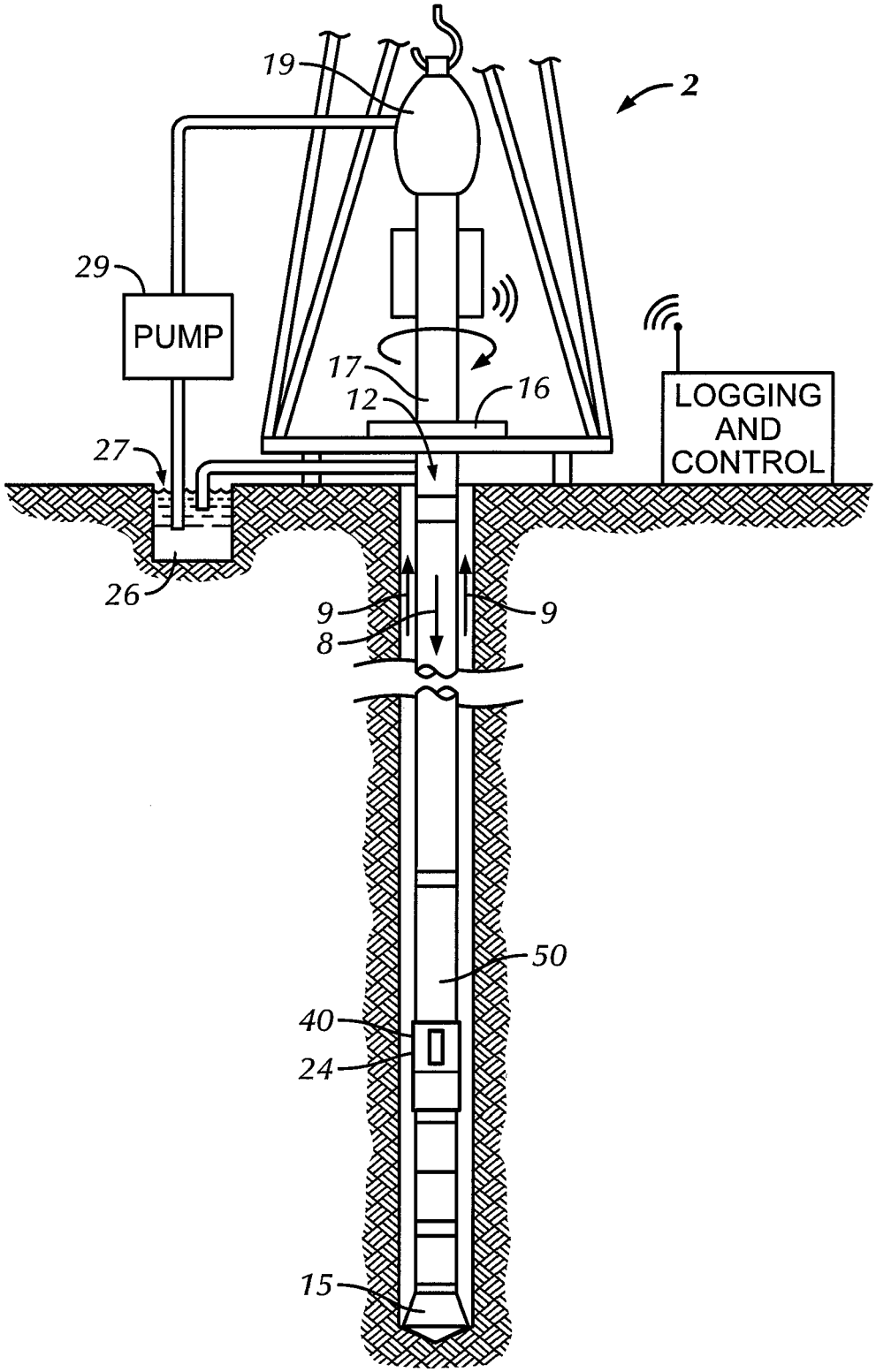
FIG. 2 (Prior Art)
FIG. 2 shows another example of a conventional logging-while-drilling tool with transducers mounted thereon.
Figure 3:
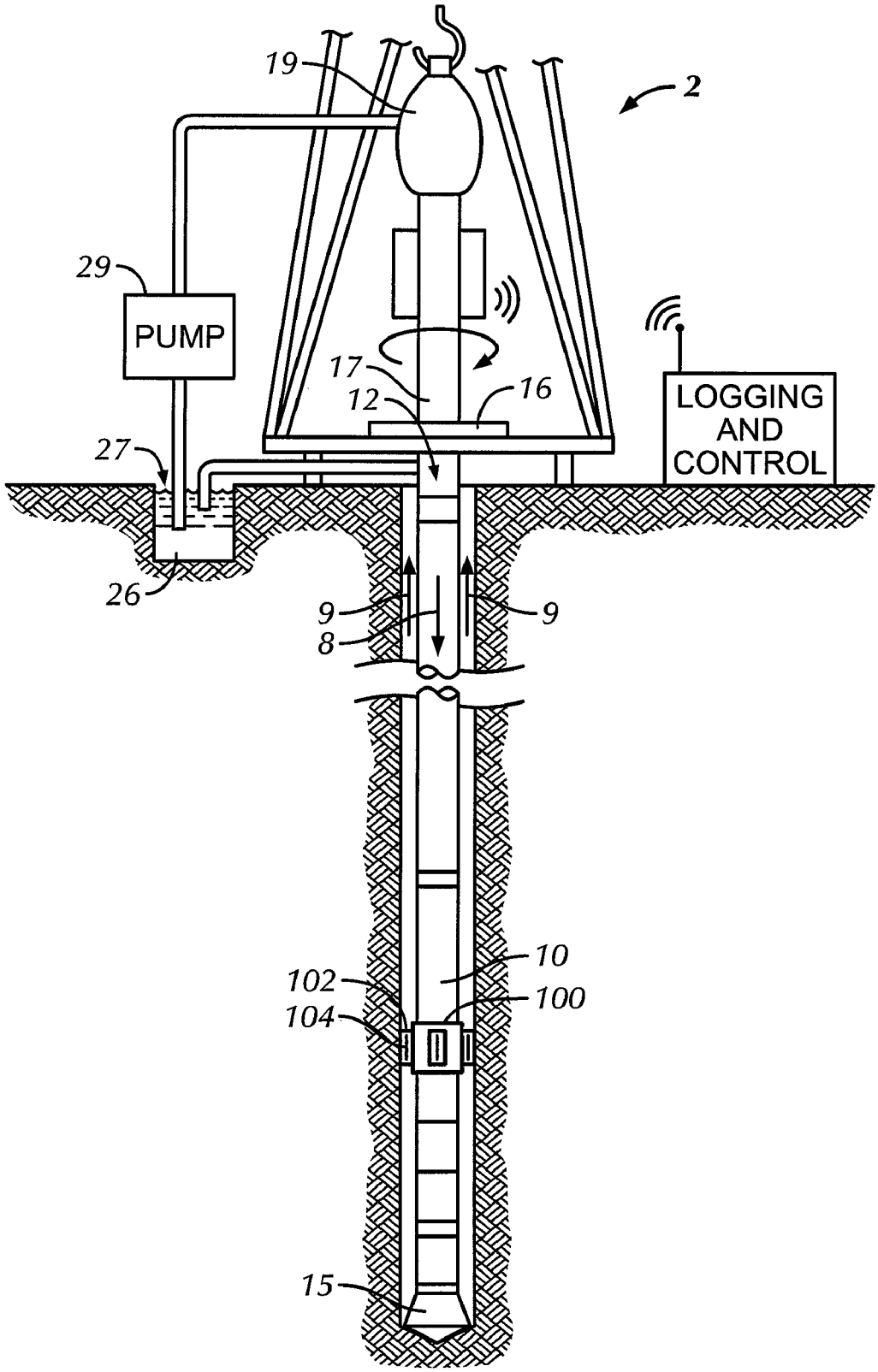
FIG. 3 shows a method and apparatus of mounting transducers closer to a borehole wall in accordance with one or more embodiments of the present invention.
Figure 4A:
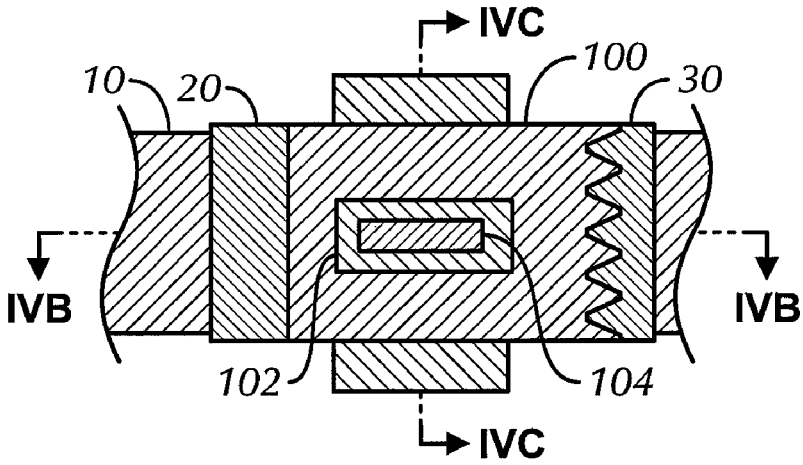
FIG. 4A shows a side view of a sleeve mounted on a drill collar in accordance with one or more embodiments of the present invention.
Figure 4B:
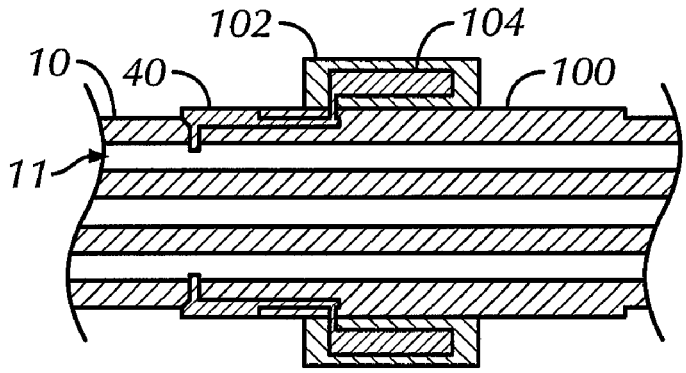
FIG. 4B shows a cross-sectional view along line IVB-IVB of the sleeve shown in FIG. 4A.
Figure 4C:
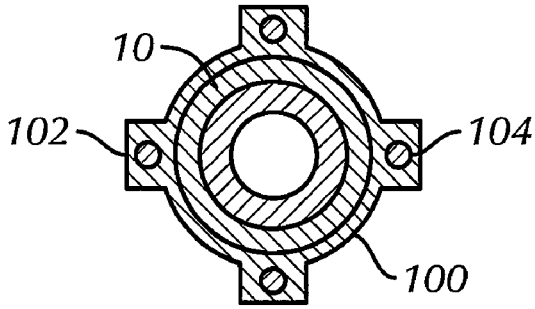
FIG. 4C shows a cross-sectional view along line IVC-IVC of the sleeve shown in FIG. 4A.

FIG. 3 illustrates a wellsite system in which embodiments of the present invention may be employed. One or more embodiments provide an interchangeable sleeve configured to circumferentially engage a downhole tool (e.g., a drill collar) of a drilling assembly. FIGS. 4A-4C show an interchangeable sleeve 100 according to one or more embodiments of the present invention. As shown in FIG. 4A, the sleeve 100 circumferentially engages a drill collar 10, and is located and held in a particular orientation by a locking mechanism 30 configured to prevent vibration and rotation of the sleeve 100. In one or more embodiments, the locking mechanism 30 may be a mechanical interface with toothed mating parts that secure the sleeve 100 in place on the drill collar 10, as shown in FIG. 4A. The sleeve 100 may further be held in place with a circular lock ring 20. The lock ring 20 may be a well-known lock ring used for preventing rotation and axial movement of a sleeve or stabilizer on the drill collar.

FIG. 4B shows a cross-sectional view along line IVB-IVB of FIG. 4A. According to one or more embodiments, one or more transducers 104 may be disposed within the sleeve 100, and the transducers 104 may be electrically connected via electronics cavity 11 within the drill collar 10. The electronics cavity 11 may be configured to maintain electronic components, e.g., a printed circuit board, thereby protecting the logging tool electronics from the wellbore fluid. Further, the transducers 104 may be electrically connected through the drill collar 10 via a bulkhead connector 40, as is well known in the art.

FIG. 4C shows a cross-sectional view along line IVC-IVC of FIG. 4A. In one or more embodiments, the sleeve 100 may have a plurality of blades 102 extending radially from a body of the sleeve 100, which is shown as having a substantially cylindrical shape. Further, as shown in FIGS. 4B and 4C, the transducers 104 are disposed within the blades 102.

Figure 5A:
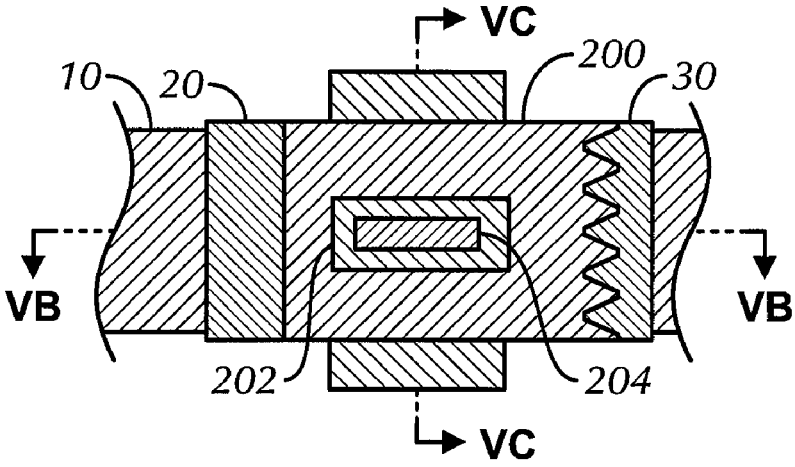
FIG. 5A shows a side view of a sleeve mounted on a drill collar in accordance with one or more embodiments of the present invention.
Figure 5B:
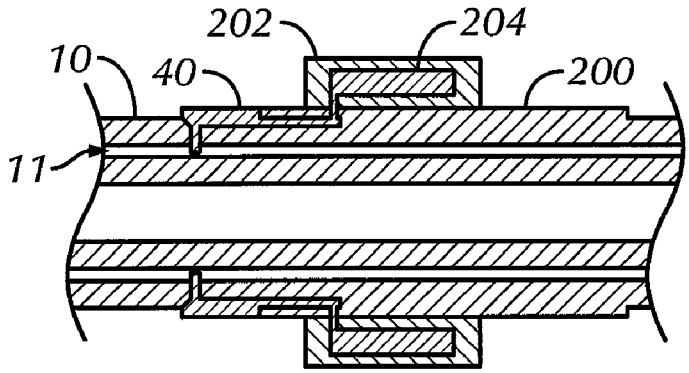
FIG. 5B shows a cross-sectional view along line VB-VB of the sleeve shown in FIG. 5A.
Figure 5C:
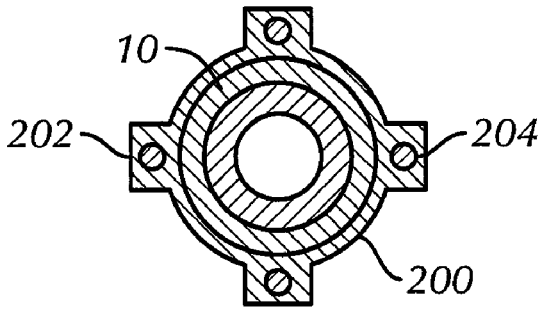
FIG. 5C shows a cross-sectional view along line VC-VC of the sleeve shown in FIG. 5A.
Figure 6A:
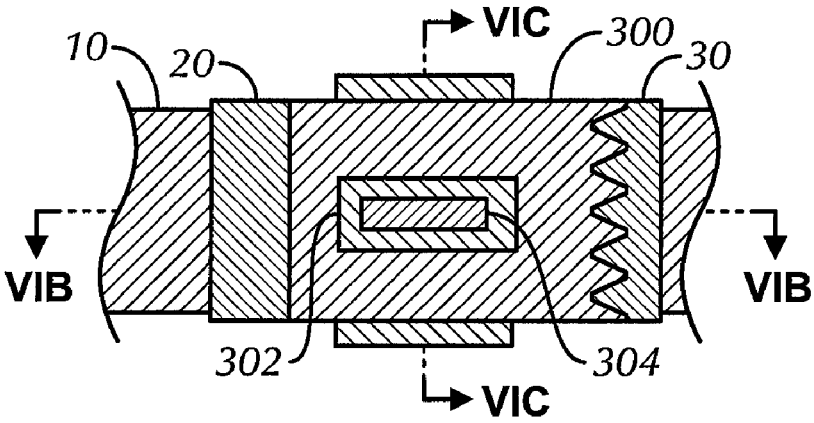
FIG. 6A shows a side view of a sleeve mounted on a drill collar in accordance with one or more embodiments of the present invention.
Figure 6B:
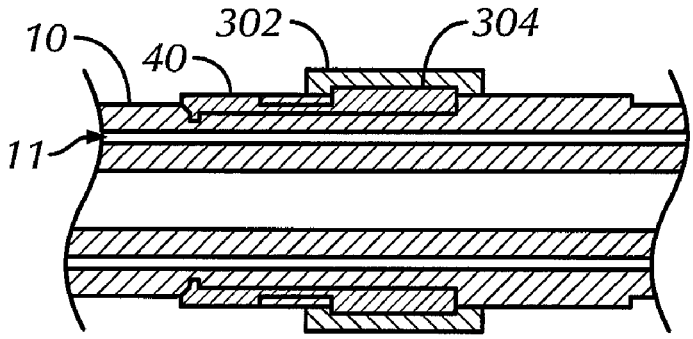
FIG. 6B shows a cross-sectional view along line VIB-VIB of the sleeve shown in FIG. 6A.
Figure 6C:
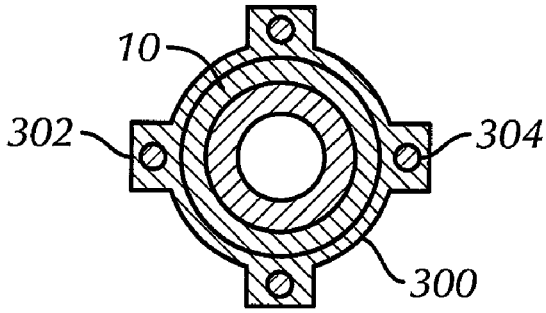
FIG. 6C shows a cross-sectional view along line VIC-VIC of the sleeve shown in FIG. 6A.

FIGS. 5A-5C show one embodiment of a sleeve 200 having a plurality of large blades 202 and large transducers 204, and FIGS. 6A-6C show one embodiment of a sleeve 300 having a plurality of small blades 302 and small transducers 304. The sleeves 200 and 300 are substantially similar to the sleeve 100 except for the size of the blades and the size of the transducers. Like components in the figures are designated by like numerals and their description is omitted.

Figure 13:
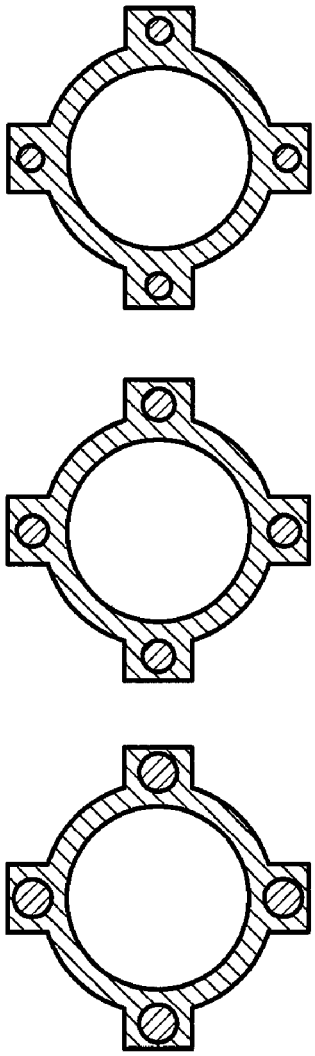
FIG. 13 shows cross-sectional views of various sizes of blades and transducers of a sleeve according to one or more embodiments of the present invention.

As can be seen by comparing FIGS. 4-6, according to one or more embodiments, the size of the blades and transducers may vary from sleeve to sleeve. FIG. 13 further illustrates how the size the blades and the size of the transducers may differ depending on the size of a borehole of a particular logging run. Therefore, the size of the blades and the size of the transducers may be modified to accommodate a particular borehole or operational constraints, while the dimensions (e.g., diameter, length, wall thickness, etc.) of the drill collar remain the same. For example, a sleeve having larger blades may be selected for logging larger boreholes, while a sleeve having smaller blades may be selected for logging smaller boreholes. A particular sleeve may be selected such that the distance between the blades and the inner diameter of the borehole wall is minimal. According to one or more embodiments, the size of the transducers may be proportional to the size of the blades, as can be seen by comparing FIGS. 4-6.

More specifically, the blades 202 of the embodiment of the sleeve 200 shown in FIGS. 5A-5C are larger than the blades 102 of the sleeve 100 shown in FIGS. 4A-4C. Thus, to accommodate a larger borehole, the sleeve 100 may be interchanged with the sleeve 200. The transducers 204 are also larger to provide additional energy necessary to excite the larger borehole. On the other hand, the blades 302 and the transducers 304 of the embodiment of the sleeve 300 shown in FIGS. 6A-6C are smaller than the blades 102 and the transducers 104. Thus, to accommodate a smaller borehole, the sleeve 100 may be interchanged with the sleeve 300. According to one or more embodiments of the sleeve 300, the transducers 304 may extend into a recess or cavity in the drill collar such that the transducers 304 are partially disposed within the drill collar, as shown in FIG. 6C. This configuration allows the transducers 304 to be housed within the smaller blades 302.

Figure 7:
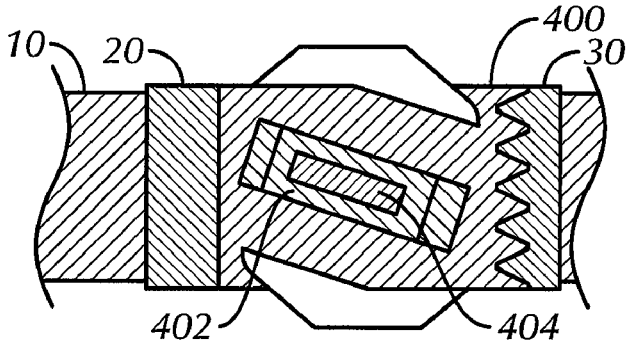
FIG. 7 shows a side view of a sleeve mounted on a drill collar in accordance with one or more embodiments of the present invention.

The blades of the sleeve according to the embodiments described herein are not limited to the straight-blade shape or orientation as shown in FIGS. 3-6. One or more embodiments may provide other shapes and orientations. FIG. 7 shows a sleeve 400 having spiraled blades 402. The sleeve 404 is substantially similar to the other sleeves described above, except that the blades 402 are configured to spiral around the sleeve.

Figure 8A:
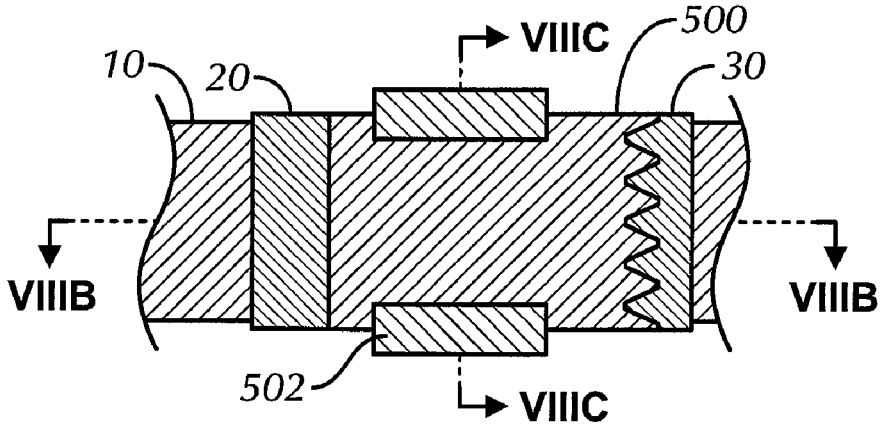
FIG. 8A shows a side view of a sleeve mounted on a drill collar in accordance with one or more embodiments of the present invention.
Figure 8B:
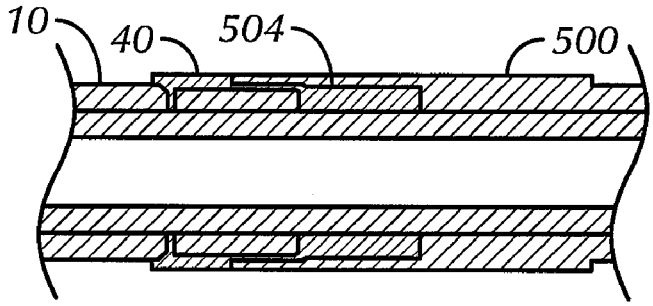
FIG. 8B shows a cross-sectional view along line VIIIB-VIIIB of the sleeve shown in FIG. 8A.
Figure 8C:
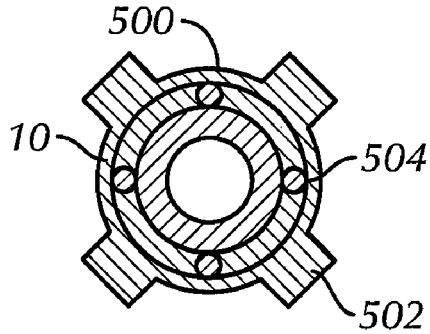
FIG. 8C shows a cross-sectional view along line VIIIC-VIIIC of the sleeve shown in FIG. 8A.

According to one or more embodiments of the present invention, instead of disposing the transducers within the blades of the sleeve, the transducers may be mounted in a drill collar and offset from the blades. FIGS. 8A-8C show one embodiment of a sleeve 500 having blades 502 and transducers 504. FIG. 8B shows a cross-sectional view along lines VIIIB-VIIIB of FIG. 8A, and FIG. 8C shows a cross-sectional view along lines VIIIC-VIIIC of FIG. 8A. As shown, the transducers 504 may be positioned offset from the blades 502. As a result of this configuration, the blades 502 may act as a baffle to prevent interference among signals, e.g., help prevent acoustic waves from cancelling each other out in the wellbore fluid before getting to the formation of the borehole wall. This design allows a stronger signal to propagate into the borehole, particularly when there is greater distance between the drill collar outer diameter and the borehole inner diameter.

Figure 9A:
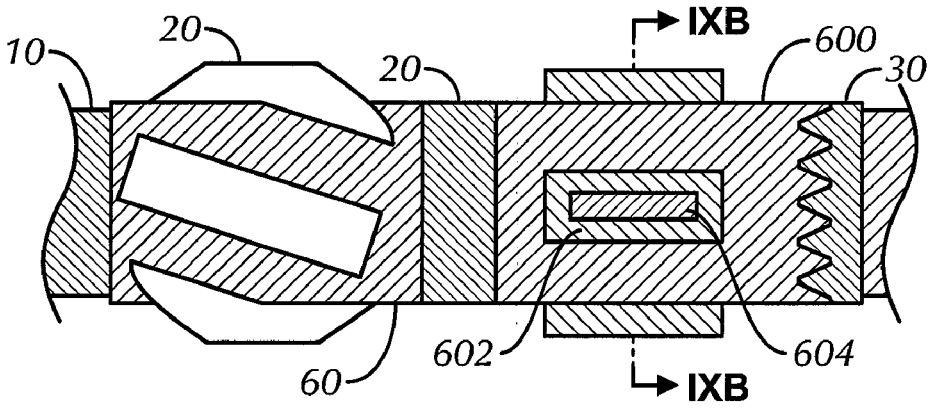
FIG. 9A shows a side view of a sleeve mounted on a drill collar in accordance with one or more embodiments of the present invention.
Figure 9B:
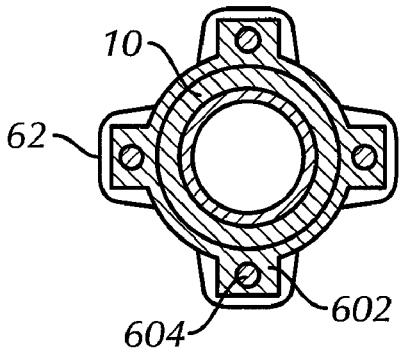
FIG. 9B shows a cross-sectional view along line IXB-IXB of the sleeve shown in FIG. 9A.

Blades of the sleeves according to embodiments described herein may also be hard-faced with wear-resistant material (not shown) including, but not limited to, ceramic material configured to protect the blades from abrasion due to contact with the borehole wall. To further protect the blades, one or more embodiments of the present invention may also provide a gauge stabilizer 60, as shown in FIGS. 9A and 9B. As can be seen, the stabilizer 60 may be configured to engage the drill collar 10 adjacent to the sleeve. The stabilizer 60 includes one or more stabilizer blades 62 which may be slightly larger than blades 602 of the sleeve 600, such that the stabilizer blades 62 prevent the blades 602 from contacting the borehole wall.

Figure 14A:
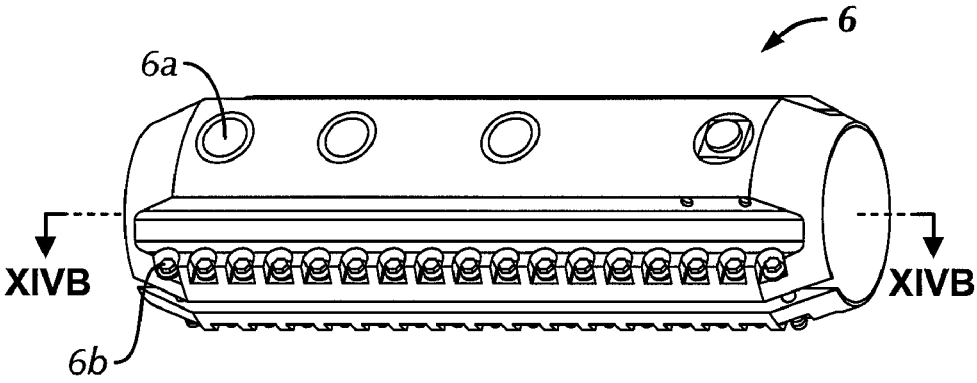
FIG. 14A (Prior Art)
FIG. 14A shows an example of a conventional sleeve with low-density windows.
Figure 14B:
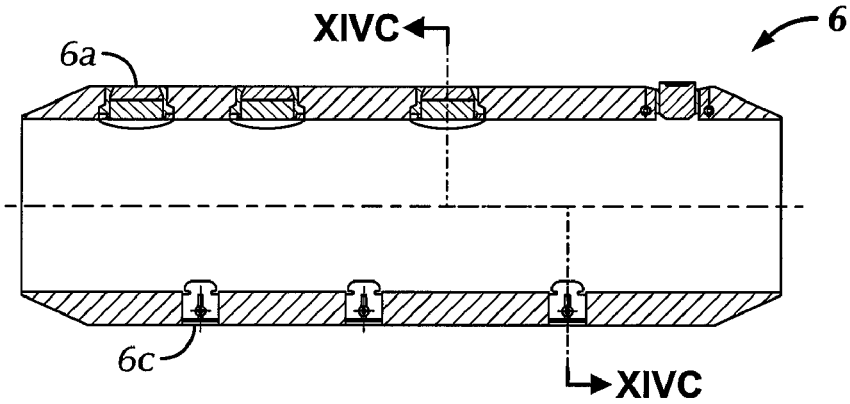
FIG. 14B (Prior Art)
FIG. 14B shows a cross-sectional view along line XIVB-XIVB of the sleeve shown in FIG. 14A.
Figure 14C:
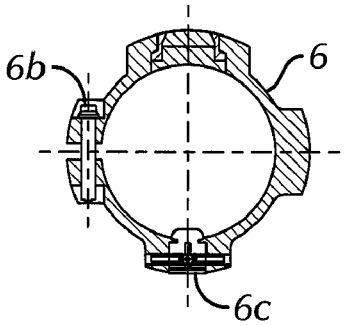
FIG. 14C (Prior Art)
FIG. 14C shows a cross-sectional view along line XIVC-XIVC of the sleeve shown in FIG. 14B.

Although FIGS. 4-9 show the locking mechanism 30 as a mechanical interface with toothed mating parts, the locking mechanism is not limited to such a configuration. For example, instead of toothed mating parts, the locking mechanism according to one or more embodiments may include dowels or bolts similar to pins 6*b* and pins 6*c* of the conventional sleeve 6 shown in FIG. 14. Those skilled in the art will recognize that the locking mechanism may include a combination of mechanisms, e.g., pins or dowels used in combination with toothed mating parts. Other configurations as are known in the art may be used to secure the sleeve in place on the drill collar.

Figure 10A:
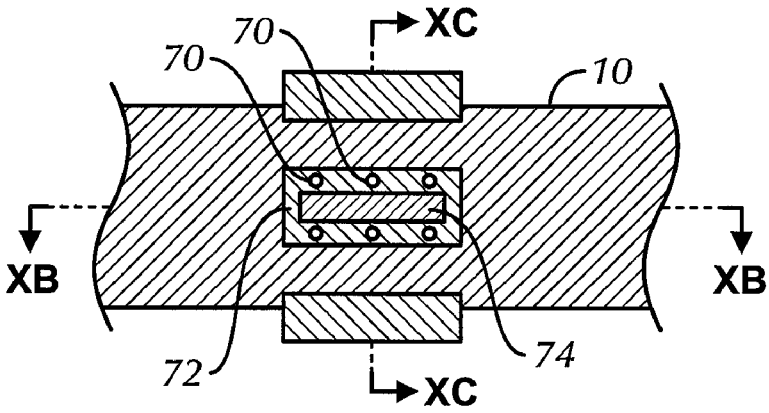
FIG. 10A shows a side view of a sleeve mounted on a drill collar in accordance with one or more embodiments of the present invention.
Figure 10B:
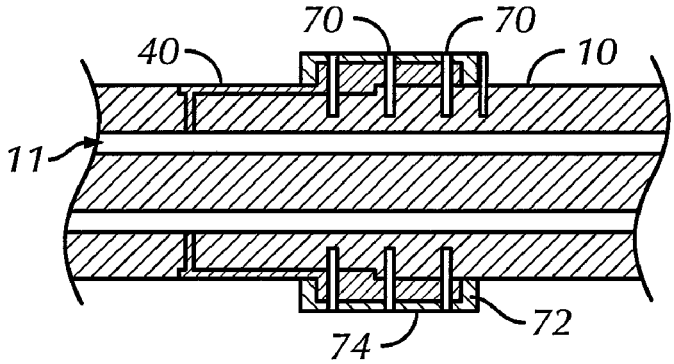
FIG. 10B shows a cross-sectional view along line XB-XB of the sleeve shown in FIG. 10A.
Figure 10C:
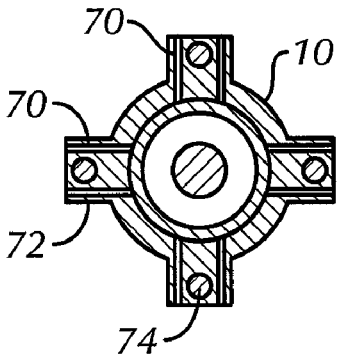
FIG. 10C shows a cross-sectional view along line XC-XC of the sleeve shown in FIG. 10A.

One or more embodiments of the present invention may further provide interchangeable blades coupled to a drill collar without a sleeve. FIG. 10A shows one embodiment of blades 72 configured to engage directly to the drill collar 10. FIG. 10B shows a cross-sectional view along lines XB-XB of FIG. 10A, and FIG. 10C shows a cross-sectional view along lines XC-XC of FIG. 10A. As can be seen in FIGS. 10B and 10C, the blades 72 may be coupled to the drill collar 10 via bolts 70. Similar to the embodiments described above, transducers 74 are disposed within the blades 72, and a size of the blades 72 may be changed according to a diameter of a borehole wall in which the drill collar 10 is to be used.

Figure 11:
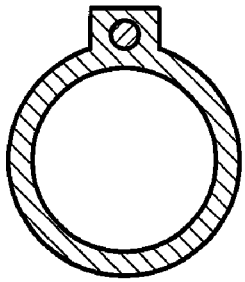
FIG. 11 shows a cross-sectional view of a sleeve having a single blade and a single transducer according to one or more embodiments of the present invention.

Although each of FIGS. 4-10 shows four blades formed on the sleeve and a transducer disposed in each of the four blades, the present invention is not limited to any particular number of blades or transducers. For example, as shown in FIG. 11, one or more embodiments of the present invention may be implemented with a sleeve or drill collar having a single blade and a single transducer. Further, a transducer need not necessarily be disposed in every blade, and the number of transducers need not necessarily match the number of blades.

Figure 12:
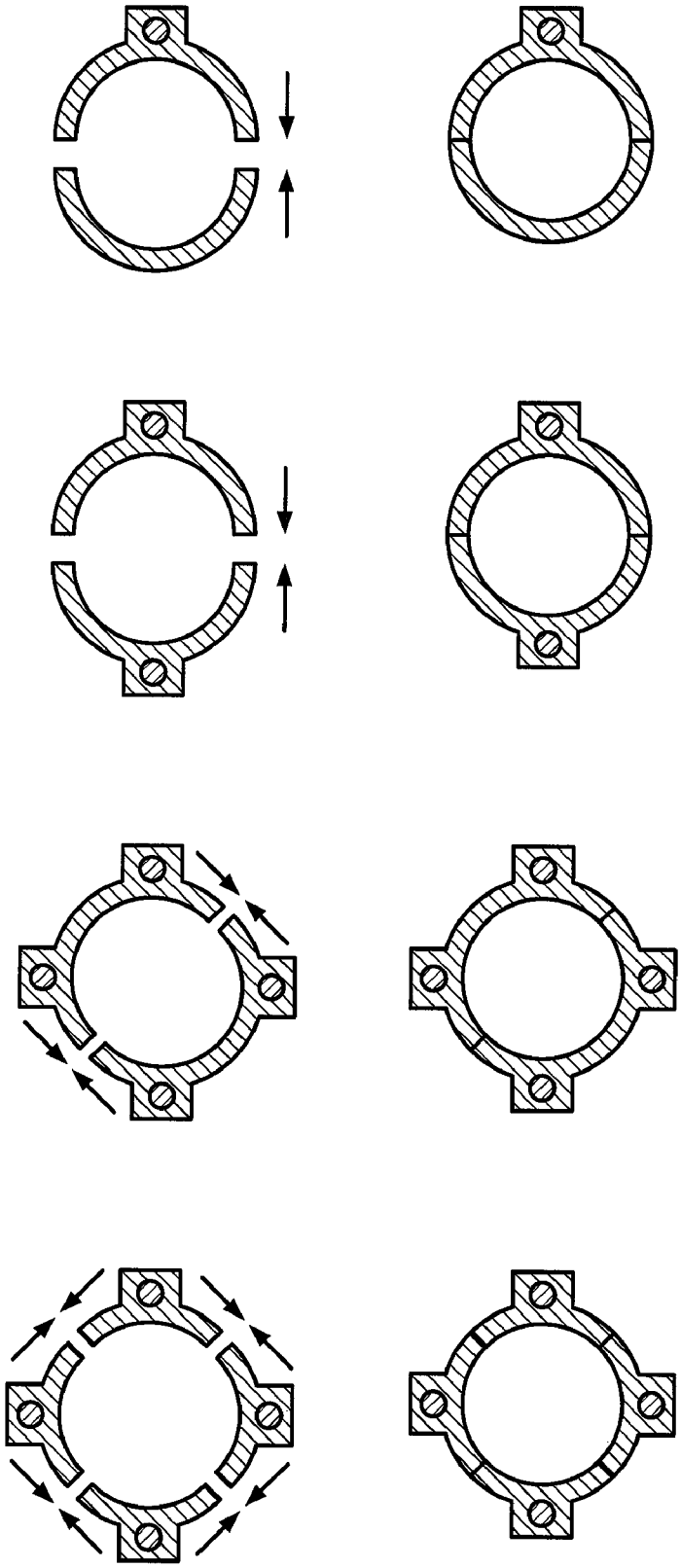
FIG. 12 shows cross-sectional views of various configurations of a sleeve according to one or more embodiments of the present invention.

The sleeves described herein may circumferentially engage the drill collar in various ways. According to one or more embodiments, the sleeve may be configured to slide onto the drill collar. Alternatively, as shown in FIG. 12, the sleeve may be composed of two or more sections configured to mutually engage about the drill collar. In this embodiment, the two or more sections may be hinged together, fastened together with mechanical devices (e.g., screws, bolts, etc.), welded together, or assembled by other known means to circumferentially engage the drill collar.

The transducers according to the embodiments described herein may be of various types, such as acoustic transducers, resistivity sensors, electromagnetic induction sensors, gamma-ray sensors, and other common types used in formation logging. The transducers may be passive or active or highly instrumented with significant circuitry such as amplifiers and microprocessors. Further, the blades and the transducers may have different sizes and geometries based on a particular logging run.

Advantages of the present invention, in accordance with one or more embodiments, may include one or more of the following.

According to one or more embodiments of the present invention, by mounting a transducer onto a blade of a sleeve that circumferentially engages a drill collar, the transducer can be placed closer to a borehole wall. This may improve the coupling of the transducer to the formation, and may enable formation properties to be derived from formation logging data with high efficiency. Similar results may be achieved by other embodiments in which transducers are mounted within interchangeable blades configured to engage the drill collar without the use of a sleeve.

Further, one or more embodiments of the present invention allow the drill collar to be the same dimensions while the sleeve or the blades are interchanged to accommodate a particular borehole size of a particular logging run. Such a design makes it unnecessary to provide multiple drill collars or drill collar/stabilizer size combinations for different borehole sizes. Accordingly, manufacturing time of the drilling assembly and cost of covering multiple borehole sizes can be significantly reduced.

Further, hard-faced blades allow the blades to be in direct contact with the borehole wall, which allows the transducers to be positioned even closer to the formation. In other embodiments, larger gauge stabilizer having stabilizer blades may be used to prevent the blades of the sleeve from contacting the borehole wall. This configuration not only protects the transducers mounted in the blades of the sleeve, but also allows the blades to have a more delicate shape.

Those skilled in the art will recognize that the sleeve according to one or more embodiments of the present invention is not limited to drill collars but may also be used on other downhole tools (e.g., drill pipes and wireline tool housings) and be configured to circumferentially engage those downhole tools. Further, a drilling assembly in accordance with one or more embodiments of the present invention may be employed onshore or offshore. Further, the embodiments of the present invention described herein are not limited to acoustics sampling, but could also be used where the measurements may be gamma-ray density, neutron porosity, formation pressure and sampling measurements, resolution resistivity measurements, etc.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An interchangeable sleeve for a downhole tool, comprising:

a body configured to circumferentially engage the downhole tool;

a blade extending radially from the body;

a transducer disposed within the blade; and a locking mechanism provided with a locating system and configured to mate with and to lock the sleeve onto the downhole tool in a longitudinal direction thereof.

2. The sleeve according to claim 1, further comprising a bulkhead connector for electrically connecting the transducer to an electronics cavity of the downhole tool.

3. The sleeve according to claim 1, further comprising:

a lock ring for stabilizing the sleeve on the downhole tool.

4. The sleeve according to claim 1, wherein the body is configured to slide onto the downhole tool.

5. The sleeve according to claim 1, wherein the body comprises at least two sections configured to mutually engage the downhole tool.

6. The sleeve according to claim 1, wherein a size of the blade and a size of the transducer are selected based on a diameter of a borehole in which the downhole tool is to be used.

7. The sleeve according to claim 6, wherein the transducer is partially disposed inside the downhole tool.

8. The sleeve according to claim 1, further comprising:

at least one additional blade extending radially from the body; and a transducer disposed within each of the at least one additional blade.

9. The sleeve according to claim 1, wherein a hard-facing material is disposed on a surface of the blade.

10. The sleeve according to claim 1, wherein a stabilizer circumferentially engages the downhole tool, the stabilizer comprising one or more stabilizer blades configured to prevent the blade of the sleeve from contacting a borehole wall.

11. The sleeve according to claim 1, wherein the blade is formed spirally around the body.

12. A drilling assembly comprising:

a drill collar; and an interchangeable sleeve comprising:

a substantially cylindrical body configured to circumferentially engage the drill collar;

a blade extending radially from the body;

a transducer disposed within the blade; and a locking mechanism provided with a locating system and configured to mate with and to lock the sleeve onto the downhole tool in a longitudinal direction thereof.

13. The drilling assembly according to claim 12, further comprising a bulkhead connector for electrically connecting the transducer to an electronics cavity of the drill collar.

14. The drilling assembly according to claim 12, further comprising:

a lock ring for stabilizing the sleeve on the drill collar.

15. The drilling assembly according to claim 12, wherein the body of the sleeve is configured to slide onto the drill collar.

16. The drilling assembly according to claim 12, wherein the body of the sleeve comprises at least two sections configured to form a cylinder when mutually engaged about the drill collar.

17. The drilling assembly according to claim 12, wherein a size of the blade and a size of the transducer are selected based on a diameter of a borehole in which the drill collar is to be used.

18. The drilling assembly according to claim 17, wherein the drill collar comprises a cavity, and the transducer is disposed so as to be partially in the drill collar and partially in the blade.

19. The drilling assembly according to claim 12, wherein the sleeve further comprises:

at least one additional blade extending radially from the body; and a transducer disposed within each of the at least one additional blade.

20. The drilling assembly according to claim 12, wherein a hard-facing material is disposed on a surface of the blade.

21. The drilling assembly according to claim 12, further comprising a stabilizer configured to circumferentially engage the drill collar, the stabilizer comprising one or more stabilizer blades configured to prevent the blade of the sleeve from contacting a borehole wall.

22. The drilling assembly according to claim 12, wherein the blade is formed spirally around the body.

23. A drilling assembly comprising:

a downhole tool;

an interchangeable sleeve comprising:

a body configured to circumferentially engage the downhole tool;

a plurality of blades extending radially from the body; and a locking mechanism provided with a locating system and configured to mate with and to lock the sleeve onto the downhole tool in a longitudinal direction thereof; and a plurality of transducers disposed within the downhole tool and positioned to be offset from the blades.

24. A method of manufacturing an interchangeable sleeve for a downhole tool, the method comprising:

forming a blade on a body of the sleeve such that the blade extends radially from the body;

disposing a transducer within the blade; and configuring the sleeve to circumferentially engage the downhole tool, wherein the configuring comprising providing a locking mechanism with a locating system and configuring to mate with and to lock the sleeve onto the downhole tool in a longitudinal direction thereof.

25. A method of mounting transducers onto a downhole tool, the method comprising:

providing an interchangeable sleeve comprising:

a body;

a blade extending radially from the body; and a transducer disposed within the blade; and circumferentially engaging the sleeve about the downhole tool, wherein the circumferentially engaging comprising providing a locking mechanism with a locating system and configuring to mate with and to lock the sleeve onto the downhole tool in a longitudinal direction thereof.

26. A method of mounting transducers onto a downhole tool, the method comprising:

providing a plurality of interchangeable sleeves, each having a body;

forming a blade extending radially from the body on each of the sleeves, wherein a size of the blade is different for each of the sleeves;

disposing a transducer within each of the blades, wherein a size of the transducer is proportional to the size of the blade;

selecting a sleeve based on a diameter of a borehole in which the downhole tool is to be used; and circumferentially engaging the selected sleeve about the downhole tool, wherein the circumferentially engaging comprising providing a locking mechanism with a locating system and configuring to mate with and to lock the sleeve onto the downhole tool in a longitudinal direction thereof.

* * * * *